US009630212B2

(12) United States Patent
Tsukamoto et al.

(10) Patent No.: US 9,630,212 B2
(45) Date of Patent: Apr. 25, 2017

(54) METHOD FOR THE FORMATION OF MULTI-LAYER PAINT FILMS

(75) Inventors: Eishi Tsukamoto, Yokohama (JP); Masazumi Maekawa, Yokohama (JP); Shigeyuki Mizuno, Yokohama (JP); Takakazu Yamane, Hiroshima (JP); Kazuhi Koga, Hiroshima (JP); Sakura Nakano, Hiroshima (JP)

(73) Assignees: BASF Japan Ltd., Tokyo (JP); Mazda Motor Corporation, Hiroshima (JP)

( * ) Notice: Subject to any disclaimer, the term of this patent is extended or adjusted under 35 U.S.C. 154(b) by 0 days.

(21) Appl. No.: 13/265,988

(22) PCT Filed: Mar. 31, 2010

(86) PCT No.: PCT/IB2010/000753

§ 371 (c)(1),
(2), (4) Date: Oct. 24, 2011

(87) PCT Pub. No.: WO2010/122386

PCT Pub. Date: Oct. 28, 2010

(65) Prior Publication Data

US 2012/0045585 A1 Feb. 23, 2012

(30) Foreign Application Priority Data

Apr. 24, 2009 (JP) ..... 2009-106057

(51) Int. Cl.
*B05D 7/00* (2006.01)

(52) U.S. Cl.
CPC ..... *B05D 7/577* (2013.01); *B05D 2601/20* (2013.01)

(58) Field of Classification Search
CPC ..... B05D 2601/20; B05D 7/577
See application file for complete search history.

(56) References Cited

U.S. PATENT DOCUMENTS

| | | | | | |
|---|---|---|---|---|---|
| 5,844,801 | A * | 12/1998 | Kodama | B62D 65/005 | 382/141 |
| 2002/0136837 | A1 | 9/2002 | Kobayashi et al. | | |
| 2003/0158321 | A1* | 8/2003 | Watanabe et al. | 524/449 | |
| 2007/0134430 | A1* | 6/2007 | Kenmoku et al. | 427/427.3 | |

FOREIGN PATENT DOCUMENTS

| | | | | |
|---|---|---|---|---|
| JP | 2003181368 | A | 7/2003 | |
| JP | 2004097917 | A | 4/2004 | |
| JP | 2004298836 | A | 10/2004 | |
| JP | 2004337670 | A | 12/2004 | |
| WO | WO2005/021168 | A1 | 3/2005 | |
| WO | WO 2005021168 | A1 * | 3/2005 | |
| WO | WO2009024351 | * | 2/2009 | C09D 133/06 |
| WO | WO2009157588 | * | 12/2009 | B05D 7/14 |

OTHER PUBLICATIONS

International Preliminary Report on Patentability for International Application No. PCT/IB2010/000753 dated Oct. 25, 2011, 5 pages.
International Search Report for International application No. PCT/IB2010/000753 dated Jul. 9, 2010.
Written Opinion for International application No. PCT/IB2010/000753.

* cited by examiner

*Primary Examiner* — James M Mellott
(74) *Attorney, Agent, or Firm* — Servilla Whitney LLC

(57) ABSTRACT

A method of forming a multi-layer paint film comprising coating an aqueous first colored base paint (A) on an electro-deposition paint cured paint film to form a first colored base paint film, coating an aqueous second colored base paint (B) on the first colored base paint film without preliminary heating of the first colored base paint film to form a second colored base paint film, coating a clear paint (C) coated on the second colored base paint film after preliminary heating of the first paint film and second paint film to form a clear paint film, and heating and curing the three paint films at the same time, wherein a talc pigment is included in each of paint (A) and paint (B) in an amount of from 1 to 5 mass % with respect to the total resin solid fraction of each of paint (A) and paint (B).

7 Claims, No Drawings

METHOD FOR THE FORMATION OF MULTI-LAYER PAINT FILMS

CROSS REFERENCE TO RELATED APPLICATIONS

This application is a National Phase Application of Patent Application PCT/IB2010/000753 filed on 31 Mar. 2010, which claims priority to JP 2009-106057, filed 24 Apr. 2009, both of which are hereby incorporated by reference in their entirety.

TECHNICAL FIELD

The present invention concerns a method for the formation of multi-layer paint films, and more precisely a method for the formation of multi-layer paint films which provide a good paint film appearance and chipping resistance on forming a three-coat one-bake paint film using aqueous paints for use on automobile outer panels.

BACKGROUND OF THE INVENTION

The method for the formation of multi-layer paint films on an object which is to be painted with a three-coat one-bake system comprising the processes 1 to 5 indicated below using an aqueous first colored paint (A), an aqueous second colored paint (B) and a clear paint (C) is known as a method for the formation of aqueous three-coat one-bake (3C1B) multi-layer films which have a good finish without the formation of runs, unevenness or interlayer mixing. Process 1: A process in which an aqueous first colored paint (A) comprising urethane emulsion (a) and other components (b) is applied. Process 2: A process in which the paint film viscosity of the aqueous first colored paint (A) is set to at least $1\times10^3$ Pa·sec (20° C., shear rate 0.1 sec.$^{-1}$) by setting at normal temperature. Process 3: A process in which an aqueous second colored paint (B) is applied. Process 4: A process in which preliminary heating is carried out. Process 5: A process in which a clear paint (C) is applied and then the paint film comprising three layers is all baked and dried at the same time. (For example, see Patent Citation 1) However, with this method little consideration is given to the paint film properties and there is a weakness in that the chipping resistance is poor.

Furthermore, a method for forming a multi-layer paint film in which an aqueous mid-coat paint (1), an aqueous base paint (2) and a clear paint are coated sequentially wet-on-wet on a base material on which an electrodeposited paint film has been formed and the multi-layer paint film obtained is all baked and hardened at the same time, which is characterized in that the aforementioned aqueous mid-coat paint (1) includes an acrylic emulsion of average particle diameter from 0.05 to 10 μm, a urethane emulsion of average particle diameter from 0.01 to 1 μm and a curing agent, the average particle diameter of the acrylic emulsion is the same as, or greater than, the average particle diameter of the urethane emulsion and the acrylic emulsion/urethane emulsion number ratio is from 1/0.1 to 1/500, is known as a method in which the impact resistance and appearance of the paint film are improved using an aqueous paint for both the mid-coat and base paint in a 3C1B painting system (for example see Patent Citation 2). However, there is a weakness with this method in that the improvement in the chipping resistance is inadequate.

Furthermore, a method for the formation of multi-layer paint films which includes (1) a process in which an object to be painted on which an electrodeposited paint film has been formed is provided; (2) a process in which an aqueous mid-coat paint is applied over the electrodeposited paint film and a mid-coat paint film is formed; (3) a process in which an aqueous base paint, and a clear paint, are coated sequentially wet-on-wet over the mid-coat paint film without curing the mid-coat paint film and a base paint film and a clear paint film are formed; and (4) a process in which the mid-coat paint film, the base paint film and the clear paint film are all baked and cured at the same time, which is characterized in that said aqueous mid-coat paint contains acrylic resin emulsion, curing agent and titanium oxide pigment which has been treated with organic material, is known as an aqueous 3C1B multi-layer paint film forming method with which the properties of the mid-coat paint film are improved and the chipping resistance of the multi-layer paint film is improved (for example, see Patent Citation 3). However, with this method the mid-coat paint film of the first layer is of a light color since it contains much titanium oxide which is a white pigment, and in those cases where the multi-layer paint film has a deep color it must be colored with just the second layer and the reproducibility of the paint color is unstable, and there is a further weakness in that the chipping resistance is also inadequate.

Furthermore, a method for the formation of a multi-layer paint film in which a colored first base paint (A) and a colored second base paint (B) are applied and then a clear paint (C) is applied wet-on-wet, after which the multi-layer paint film comprising the three layers is all heated and crosslink-cured at the same time, which is characterized in that a colored first base paint (A) of which the Young's modulus of the cured paint film of the colored first base paint (A) at −20° C. is at least 3000 MPa and the breaking energy is at least $2\times10^{-3}$ J, is known as a 3C1B multi-layer paint film forming method with which the paint film property values include good chipping resistance where a paint which has good chipping resistance has been developed (for example, see Patent Citation 4). However, with this method the paint film properties of the first layer are specified but the means by which this is achieved are unclear, and according to the detailed description of the invention it is impossible to reach the specified paint film values unless a solvent-based paint which gives rise to problems with the VOC discharge regulations is used for the first layer and there is a problem in that good chipping resistance is not obtained.

PRIOR ART LITERATURE

Patent Citations

Patent Citation 1:
Japanese Unexamined Patent Application Laid Open 2004-097917
Patent Citation 2:
Japanese Unexamined Patent Application Laid Open 2004-337670
Patent Citation 3:
Japanese Unexamined Patent Application Laid Open 2004-298836
Patent Citation 4:
Japanese Unexamined Patent Application Laid Open 2003-181368

The present invention resolves the abovementioned problems and is intended to provide a method with which a multi-layer paint film which has excellent chipping resistance without loss of the paint film appearance is formed with a three-coat one-bake method in which aqueous colored base paints are used.

SUMMARY OF THE INVENTION

As a result of thorough research carried out with a view to resolving these problems, the inventors have discovered that the abovementioned problems can be resolved with a method for forming a multi-layer paint film in which an aqueous first colored base paint (A) is coated on an electro-deposition paint cured paint film and a first colored base paint film is formed, then an aqueous second colored base paint (B) is coated on the first colored base paint film without preliminary heating of the first colored base paint film and a second colored base paint film is formed, and then a clear paint (C) is coated on the second colored base paint film after preliminary heating of the first colored base paint film and second colored base paint film and a clear paint film is formed and the three paint films which have been formed are heated and cured at the same time by including talc pigment in each of the aqueous colored first base paint (A) and aqueous colored second base paint (B) in an amount of from 1 to 5 mass % with respect to the total resin solid fraction of said aqueous colored first base paint (A) and aqueous colored second base paint (B), and the invention is based upon this discovery.

That is to say, the present invention provides a method for the formation of multi-layer paint films in which an aqueous first colored base paint (A) is coated on an electro-deposition paint cured paint film and a first colored base paint film is formed, then an aqueous second colored base paint (B) is coated on the first colored base paint film without preliminary heating of the first colored base paint film and a second colored base paint film is formed, and then a clear paint (C) is coated on the second colored base paint film after preliminary heating of the first colored base paint film and second colored base paint film and a clear paint film is formed and the three paint films which have been formed are heated and cured at the same time, characterized in that talc pigment is included in each of the aqueous colored first base paint (A) and aqueous colored second base paint (B) in an amount of from 1 to 5 mass % with respect to the total resin solid fraction of each of said aqueous colored first base paint (A) and aqueous colored second base paint (B).

Furthermore, the invention provides a method for the formation of multi-layer paint films in which, in the abovementioned method for the production of multi-layer paint films, the proportion of the total amount of polyurethane resin (a), polyester resin (b) and melamine resin (c) included in each of the aqueous first colored paint (A) and aqueous second colored paint (B) is at least 70 mass % with respect to the total resin solid fraction of each of said paints.

Furthermore, the invention provides a method for the formation of multi-layer paint films in which, in the abovementioned method for the production of multi-layer paint films, the aqueous first colored base paint (A) and the aqueous second colored base paint (B) are paints which contain the same resin constituting components and pigments.

Furthermore, the invention provides a method for the formation of multi-layer paint films in which, in the abovementioned method for the production of multi-layer paint films, the clear paint (C) is a two-liquid urethane type paint which includes a main agent which contains a hydroxyl group-containing acrylic resin and a curing agent which contains a polyisocyanate compound.

Furthermore, the invention provides a method for the formation of multi-layer paint films in which, in the abovementioned method for the production of multi-layer paint films, the hydroxyl group-containing acrylic resin included in the clear paint (C) is a hydroxyl group-containing acrylic resin of which the hydroxyl group value is from 150 to 200 mgKOH/g, the acid value is from 4 to 15 mgKOH/g, the glass transition point is from 20 to 35° C. and the weight average molecular weight is from 4,000 to 7,000, and all of the hydroxyl groups in the resin are primary hydroxyl groups.

Furthermore, the invention provides a method for the formation of multi-layer paint films in which, in the abovementioned method for the production of multi-layer paint films, the curing agent of the clear paint (C) includes an aliphatic polyisocyanate compound.

Furthermore, the invention provides a method for the formation of multi-layer paint films in which, in the abovementioned method for the production of multi-layer paint films, the base material on which an electro-deposition paint cured paint film has been formed is of at least one type selected from among alloyed molten zinc-plated steel sheet, molten zinc-plated steel sheet, electrically zinc-plated steel sheet and cold rolled steel sheet.

DETAILED DESCRIPTION OF A PREFFERED EMBODIMENT OF THE INVENTION

It is possible with the method for the formation of multi-layer paint films of this invention to provide good paint film appearance and excellent chipping resistance with a multi-layer paint film which has been obtained by applying three paints and baking them all at the same time. This method for the formation of multi-layer paint films is particularly useful in the automobile painting field.

In this invention the talc pigment is included in each of the aqueous first colored base paint (A) and aqueous second colored base paint (B) with a view to improving the chipping resistance. The amount of talc pigment included is from 1 to 5 mass %, and preferably from 2 to 4 mass %, with respect to the total resin solid fraction of each of the paints (A) and (B). With less than 1 mass % the chipping resistance improving effect is slight, and if the amount exceeds 5 mass % then this results in a decline in the paint film appearance and the chipping resistance falls.

It is conjectured that the reason why the talc pigment which can be represented by the chemical compositional formula $Mg_3Si_4O_{10}(OH)_2$ has an effect on the chipping resistance is because it has a petal or scale-like form and is light and readily flexed so that when it is included in a paint film it has the effect of adsorbing and dispersing the impact in the chipping test.

The already known aqueous thermally curable type paints which include one or more type of base resin such as acrylic resin, polyester resin, epoxy resin, polyurethane resin, polyurethane/acrylic resin or the like, one or more type of crosslinking agent such as amino resin, blocked isocyanate or the like, and one or more type of polyether-based plasticizer such as polyethylene glycol, polypropylene glycol or the like as resin constituting components can be used for the aqueous first colored base paint (A) and the aqueous second colored base paint (B) in this invention, and one or more inorganic pigment, organic pigment, aluminum pigment, pearl pigment, true pigment or the like as well as the various additives such as surface controlling agents, anti-foaming agents, surfactants, film-formation aids, thickeners, anti-fungal agents, ultraviolet absorbers, photo-stabilizers, antioxidants and the like, as required, and one or more of the various rheology-controlling agents and the various organic solvents and the like which are known in the paint industry can be compounded together with these resin constituting components.

Amino resins, blocked isocyanate compounds and the like can be cited as crosslinking agents which can be used in each of the aqueous first colored base paint (A) and aqueous second colored base paint (B) in this invention, but the amino resins are preferred.

Melamine resins, urea resins, benzoguanamine resins and the like can be cited as amino resins, but the melamine resins are preferred, the alkyl etherified melamine resins are more desirable and the melamine resins which are substituted with methoxy groups alone or with both methoxy groups and butoxy groups are especially desirable.

Unlike the paint film structures on automobile bodies generally (where there are generally, from the bottom, electrodeposited, mid-coat, colored base and clear paint film layers), there is nothing which corresponds to a mid-coat paint film layer in the three-coat one-bake multi-layer paint film forming method in this invention. Consequently, in this invention some of the function of the mid-coat paint (improvement of the paint film appearance and chipping resistance) must be taken on by the aqueous first colored base paint (A) and the aqueous second colored base paint (B). These functions predominate in the combination with the clear paint (C) as well and so the selection of the clear coat paint (C) which is combined is also important.

Furthermore, unlike the other general three-coat one-bake multi-layer paint film forming methods, there is no process in which preliminary heating is carried out after applying the first layer paint in the three-coat one-bake multi-layer paint film forming method in this invention, and there is only one preliminary heating process after the aqueous first colored base paint (A) and the aqueous second colored base paint (B) have been applied. Consequently, in this invention, in order to avoid any decline in the paint film appearance due to thermal shrinkage in the heating and curing process after the clear paint (C) has been applied, the aqueous first colored base paint (A) and the aqueous second colored base paint (B) are preferably paints which contain similar or the same type resin constituting components and pigment, and more desirably they are paints which include the same resin constituting components and pigment. Depending on the color, they may be paints which include the same resin constituting components and just the colored pigment may differ. Furthermore, paints with the same compounding proportions of the components such as the resin constituting components and pigment are the same are especially desirable.

The resin constituting components of each of the aqueous first colored base paint (A) and aqueous second colored base paint (B) preferably include a polyurethane resin (a) and a polyester resin (b) as the base resin and a melamine resin (c) as the crosslinking agent. These resin constituting components are preferred for realizing good paint film appearance and chipping resistance when the paints are overlapped, and a total amount of at least 70 mass % with respect to the total amount of resin solid fraction is preferred for achieving these effects satisfactorily. other resin constituting components may be included as well as the polyurethane resin, polyester resin and melamine resin as resin constituting components, and examples of these other resin constituting components include polyurethane/acrylic resins, acrylic resins, polyether resins and the like.

Various polyether-based plasticizers can be used for the polyether-based plasticizers as resin constituting components, and the polyether-based plasticizers of molecular weight from 500 to 3,000 are preferred.

No particular limitation is imposed upon the polyurethane resin (a) which is used in each of the aqueous first colored base paint (A) and aqueous second colored base paint (B) in this invention, and it can be produced by reacting a polyisocyanate with a polyol. Polyester polyols are preferred for the polyol, and aliphatic diisocyanates and alicyclic diisocyanates are preferred for the polyisocyanate.

Examples of the aliphatic diisocyanates include hexamethylene diisocyanate, 2,2,4-trimethylhexa-methylene diisocyanate, lysine diisocyanate and the like, and examples of the alicyclic diisocyanates include 1,4-cyclohexane diisocyanate, isophorone diisocyanate, 4,4'-dicyclohexylmethane diisocyanate, methylcyclohexylene diisocyanate and the like. One of these may be used individually, or a combination of two or more types may be used.

Polyester polyols can be obtained by the reaction of a polyhydric alcohol and a polybasic acid and, as required, a fatty acid obtained from an oil or fat.

Examples of the polyhydric alcohols include ethylene glycol, propylene glycol, 1,3-butylene glycol, 1,4-butanediol, 1,6-hexanediol, diethylene glycol, dipropylene glycol, neopentyl glycol, triethylene glycol, hydrogenated bisphenol A, glycerine, triethanolamine, trimethylolpropane, pentaerythritol, dipentaerythritol, C36 dimer diol and the like, and one of these may be used alone, or a combination of two or more types may be used.

Furthermore, examples of the polybasic acids include phthalic acid anhydride, isophthalic acid, terephthalic acid, succinic acid anhydride, adipic acid, azeleic acid, sebacic acid, maleic acid anhydride, fumaric acid, itaconic acid, trimellitic acid anhydride, C36 dimer acid and the like, and one of these may be used alone or a combination of two or more types may be used.

Furthermore, examples of fatty acids which can be obtained from oils and fats include soybean oil fatty acid, palm oil fatty acid, safflower oil fatty acid, castor oil fatty acid, tung oil fatty acid, linseed oil fatty acid, tall oil fatty acid, lauric acid, stearic acid and the like. One of these may be used alone, or a combination of two or more types may be used.

The polyurethane resin (a) preferably has a hydroxyl group value of from 10 to 100 mgKOH/g, and more desirably of from 20 to 80 mgKOH/g. In those cases where it is below 10 mgKOH/g the emulsification stability of the resin in an aqueous medium is reduced, and in those cases where it exceeds 100 mgKOH/g the water resistance of the paint film is reduced.

Furthermore, the acid value of the polyurethane resin (a) is preferably from 10 to 50 mgKOH/g, and more desirably from 20 to 50 mgKOH/g. In those cases where it is less than 10 mgKOH/g the emulsification stability of the resin in an aqueous medium is reduced, and in those cases where it exceeds 50 mgKOH/g the water resistance of the paint film is reduced.

Furthermore, the number average molecular weight of the polyurethane resin (a) is preferably from 500 to 50,000, and more desirably from 1,000 to 30,000. In those cases where it is below 500 the chipping resistance is reduced, and in those cases where it exceeds 50,000 adequate flow properties are not obtained when baking and the appearance of the paint film declines.

No particular limitation is imposed upon the polyester resin (b) which is used in each of the aqueous first colored base paint (A) and aqueous second colored base paint (B) in this invention, and it can be obtained by means of a known esterification reaction, for example, from polyhydric alcohols and polybasic acids and, as required, the fatty acids obtained from oil and fats, which are generally used as raw materials for making polyester resins.

Examples of the polyhydric alcohols include ethylene glycol, propylene glycol, 1,3-butylene glycol, 1,4-butanediol, 1,6-hexanediol, diethylene glycol, dipropylene glycol, neopentyl glycol, triethylene glycol, hydrogenated bisphenol A, glycerine, triethanolamine, trimethylolpropane, pentaerythritol, dipentaerythritol, C36 dimer diol and the like, and one of these may be used alone, or a combination of two or more types may be used.

Furthermore, examples of the polybasic acids include phthalic acid anhydride, isophthalic acid, terephthalic acid, succinic acid anhydride, adipic acid, azeleic acid, sebacic acid, maleic acid anhydride, fumaric acid, itaconic acid, trimellitic acid anhydride, C36 dimer acid and the like, and one of these may be used alone or a combination of two or more types may be used.

Furthermore, examples of fatty acids which can be obtained from oils and fats include soybean oil fatty acid, palm oil fatty acid, safflower oil fatty acid, castor oil fatty acid, tung oil fatty acid, linseed oil fatty acid, tall oil fatty acid, lauric acid, stearic acid and the like. One of these may be used alone, or a combination of two or more types may be used.

The polyester resin (b) preferably has a hydroxyl group value of from 10 to 150 mgKOH/g, and more desirably of from 20 to 130 mgKOH/g. In those cases where it is below 10 mgKOH/g the emulsification stability of the resin in an aqueous medium is reduced, and in those cases where it exceeds 150 mgKOH/g the water resistance of the paint film is reduced.

Furthermore, the acid value of the polyester resin (b) is preferably from 10 to 50 mgKOH/g, and more desirably from 20 to 40 mgKOH/g. In those cases where it is less than 10 mgKOH/g the emulsification stability of the resin in an aqueous medium is reduced, and in those cases where it exceeds 50 mgKOH/g the water resistance of the paint film is reduced.

Furthermore, the number average molecular weight of the polyester resin (b) is preferably from 500 to 50,000, and more desirably from 1,000 to 30,000. In those cases where it is below 500 the chipping resistance is reduced, and in those cases where it exceeds 50,000 adequate flow properties are not obtained when baking and the appearance of the paint film declines.

The proportion of the total amount of the polyurethane resin (a), the polyester resin (b) and the melamine resin (c) included in the aqueous first colored base paint (A) and the aqueous second colored base paint (B) in this invention is preferably from 70 mass % to 100 mass %, and more desirably from 70 mass % to 90 mass %, with respect to the whole of the resin solid fraction.

Moreover, the proportion of melamine resin (c) included in each of the aqueous first colored base paint (A) and aqueous second colored base paint (B) is preferably from 20 to 40 mass %, with respect to the whole of the resin solid fraction. With less than 20 mass % the paint film performance declines in terms of water resistance and chipping resistance and if it exceeds 40 mass % then the chipping resistance falls.

Furthermore, the proportion of the total amount of polyurethane resin (a) and polyester resin (b) used in each of the aqueous first colored base paint (A) and aqueous second colored base paint (B) is preferably from 30 to 80 mass %, and more desirably, from 40 to 70 mass %, with respect to the total resin solid fraction. With less than 30 mass % the chipping resistance and appearance of the paint film decline, and with more than 80 mass % again the amount of crosslinking agent included is small and so the performance of the paint film in terms of the water resistance and chipping resistance is reduced.

The proportions of polyurethane resin (a) and polyester resin (b) included are preferably within the range from 50/50 to 90/10 for maintaining the paint film appearance and chipping resistance.

The known melamine resins which are suitable for use in aqueous paints can be used for the melamine resin (c) in the aqueous first colored base paint (A) and the aqueous second colored base paint (B) in this invention.

For example melamine resins where on average three or more methylol groups per individual triazine nucleus have been etherified, or melamine resins where some of the methoxy groups have been substituted with alcohols with two or more carbon atoms, and hydrophilic melamine resins which have imino groups and of which the degree of condensation is three or below can be used ideally. As commercial products, Cymel 325, Cymel 327, Cymel 350, Cymel 202, Cymel 211, Cymel 235, Cymel 250, Cymel 251, Cymel 254, Mycoat 775 (trade names, all produced by the Cytec Co.), Melan 5920, Melan 6230 (trade names, both produced by the Hitachi Kasei Co.), Luwipal 052, Luwipal 072 (trade names, both produced by the BASF Co.) and the like can be cited as examples such melamine resins.

Furthermore, the proportion of the total amount of polyurethane resin (a) and polyester resin (b) included with respect to the melamine resin (c) as the ratio by weight of the solid fractions is preferably from 55/45 to 85/15, and more desirably from 60/40 to 80/20.

The clear paint (C) in this invention may be a paint which is generally used as a clear paint for use on automobile bodies, and the solvent type one-liquid thermally curable paints of the epoxy resin crosslinking type and the acrylic/melamine crosslinking type can also be used, but in this invention the two-liquid urethane type paints comprising a hydroxyl group-containing acrylic resin and a polyisocyanate compound curing agent are preferred for maintaining the appearance of the paint film and the chipping resistance.

The two-liquid type paints are preferably solvent diluted type two-liquid urethane type paints. Examples of the diluting agent solvents include aromatic hydrocarbons such as toluene, xylene and the like, aliphatic hydrocarbons such as hexane, heptane, octane, decane and the like, ketones, ethers and the like.

The involatile fraction of the clear paint (C) is preferably from 40 to 60 mass %, and more desirably from 45 to 55 mass %.

Moreover, the hydroxyl group-containing acrylic resin has a hydroxyl group value of from 150 to 200 mgKOH/g, an acid value of from 4 to 15 mgKOH/g, a glass transition point of from 20 to 35° C. and a weight average molecular weight of from 4,000 to 7,000, and those where all of the hydroxyl groups in the resin are primary hydroxyl groups are ideal for this invention. Outside this range it is impossible to achieve satisfactorily the effects of a good paint film appearance and chipping resistance with the three-coat one-bake multi-layer paint film formation of this invention.

Furthermore, aliphatic polyisocyanate compounds are ideal for the curing agent. Outside this range it is impossible to achieve satisfactorily the effects of a good paint film appearance and chipping resistance with the three-coat one-bake multi-layer paint film formation of this invention.

Furthermore, no particular limitation is imposed upon the hydroxyl group-containing acrylic resins which are used in the clear paints (C) in this invention, and they can be obtained with a known method such as the radical polymerization of ethylenic unsaturated monomers such as acrylic monomers and the like.

For example, at least one type of hydroxyl group-containing monomer such as an ester of acrylic acid or methacrylic acid with a hydroxyl group-containing alkyl group such as 2-hydroxyethyl, 3-hydroxypropyl, 4-hydroxybutyl and the like, a caprolactone ring-opened adduct of 2-hydroxyethyl acrylate or methacrylate, or an ethylene oxide or propylene oxide adduct of 4-hydroxybutyl acrylate or methacrylate, or the like, as such an ethylenic unsaturated monomer, is included as an essential component.

Furthermore, the hydroxyl group-containing acrylic resins which can be used in this invention are preferably such that all of the hydroxyl groups included in the resin are primary hydroxyl groups.

By using primary hydroxyl groups for the hydroxyl groups which are included in the hydroxyl group-containing resin it is possible to obtain paint films which have excellent scratch resistance and acid resistance and which also have excellent chipping resistance.

Furthermore, other acrylic monomers which can be copolymerized with the abovementioned hydroxyl group containing monomers in the hydroxyl group-containing resins include acrylic and or methacrylic acid, hydrocarbyl group esters, such as the methyl, ethyl, n-propyl, isopropyl, n-butyl, isobutyl, t-butyl, hexyl, cyclohexyl, 2-ethylhexyl, lauryl, stearyl esters, of acrylic acid or methacrylic acid, acrylonitrile, methacrylonitrile, acrylamide, methacrylamide and the like. Other copolymerizable ethylenic unsaturated monomers include styrene, α-methylstyrene, maleic acid, vinyl acetate and the like. One of these copolymerizable monomers, or a combination of two or more types, can be used.

For obtaining a good paint film appearance the clear paint (C) in this invention is preferably a two-liquid urethane-type paint which includes a hydroxyl group-containing acrylic resin and a polyisocyanate compound which is the curing agent, and aliphatic polyisocyanate compounds are preferred for the polyisocyanate compound for realizing good chipping resistance. The proportions in which the hydroxyl group-containing resin and the curing agent are compounded should be the same as the compounding proportions in a normal two-liquid urethane-type paint.

The method of painting in this invention is a method for the formation of a multi-layer paint film in which an aqueous first colored base paint (A) is coated on an electro-deposition paint cured paint film and a first colored base paint film is formed, then an aqueous second colored base paint (B) is coated on the first colored base paint film without preliminary heating of the first colored base paint film and a second colored base paint film is formed, and then a clear paint (C) is coated on the second colored base paint film after preliminary heating of the first colored base paint film and second colored base paint film and a clear paint film is formed and the three paint films which have been formed are heated and cured at the same time.

Various types of electro-deposition paint can be cited as electro-deposition paints which can be used here, but the cationic electro-deposition paints are preferred. The normal methods of applying electro-deposition paints can be used for applying the electro-deposition paint. The thickness of the cured paint film of the electro-deposition paint should be the same thickness as a normal cured paint film of the electro-deposition paint.

Furthermore, at least one base material for painting selected from among pre-surface treated alloyed molten zinc-plated steel sheet, molten zinc-plated steel sheet, electrically zinc-plated steel sheet and cold rolled steel sheet is ideal for realizing better chipping resistance.

In this invention the preliminary heating after applying the aqueous second colored base paint (B) is preferably carried out at from 40 to 100° C. for from 1 to 10 minutes to obtain a good paint film appearance.

The film thickness after heating and curing (baking) each paint film layer in this invention is preferably from 5 to 30 μm for the first colored base paint (A), preferably from 5 to 30 μm for the second colored base paint (B), and preferably from 20 to 50 μm for the clear paint (C).

Furthermore the heating and curing temperature is preferably from 120 to 170° C., and the heating and curing time is preferably from 15 to 30 minutes.

Furthermore, the painting processes known in the automobile painting field with chipping primer, undercoat primer and the like can also be carried out before the painting process with the aqueous first colored base paint (A).

No particular limitation is imposed upon the method of painting in this invention, but the use of an air spray, an electrostatic air spray or a spray-painting method in which electrostatic coating apparatus of the rotary atomization type is used is preferred.

EXAMPLES

The invention is described in more detail below by means of illustrative examples. Moreover, the terms "parts" and "%" signify "parts by mass" and "mass %" respectively.

<Preparation of Polyester Polyl Resin Solution E-1>

Lauric acid (10 parts), 30 parts of maleic acid anhydride, 18.3 parts of adipic acid, 34.6 parts of neopentyl glycol and 7.1 parts of trimethylolpropane were introduced into a reactor which had been furnished with a reflux condenser fitted with a reaction-water separating tube, nitrogen gas delivery apparatus, a thermometer and stirring apparatus and mixed together and the mixture obtained was heated to 120° C. and, after dissolution, the temperature was raised to 160° C., with stirring. After being maintained at 160° C. for 1 hour the temperature was raised slowly to 230° C. over a period of 5 hours. Then the temperature was maintained at 230° C. and the reaction continued and the reaction was stopped when the acid value reached 2 mgKOH/g and the mixture was cooled. After being cooled to below 80° C., 22.8 parts of toluene were added and the polyester polyol resin solution E-1 of involatile fraction 80%, hydroxyl group value 75 mgKOH/g, acid value 2 mgKOH/g and number average molecular weight 1,500 was obtained.

<Preparation of Polyurethane Resin Solution U-1>

The polyester solution E-1 (81.8 parts), 4.7 parts of dimethylopropane, 24.2 parts of isophorone diisocyanate and 40 parts of methyl ethyl ketone were introduced into a reactor which had been furnished with nitrogen gas delivery apparatus, a thermometer and stirring apparatus and mixed together and reacted at 80° C., with stirring, 5.7 parts of diethanolamine were added when the isocyanate value had reached 0.67 meq/g and the reaction was continued at 80° C., and then 40 parts of butyl cellosolve were added when the isocyanate value reached 0.01 meq/g and the reaction was terminated. Then the toluene and methyl ethyl ketone were removed at 100° C. under reduced pressure. Then the mixture was cooled to 50° C. and 2.6 parts of diethanolamine were added and the resin was neutralized, and then de-ionized water was added and the polyurethane resin solution U-1 of involatile fraction 25%, hydroxyl group value 62 mgKOH/g, acid value 21 mgKOH/g and number average molecular weight 4,000 was obtained.

<Preparation of Polyester Resin Solution E-2>

Lauric acid (10 parts), 30 parts of maleic acid anhydride, 8.6 parts of adipic acid, 28.7 parts of neopentyl glycol and 12.7 parts of trimethylolpropane were introduced into a reactor which had been furnished with a reflux condenser fitted with a reaction-water separating tube, nitrogen gas delivery apparatus, a thermometer and stirring apparatus and mixed together and the mixture obtained was heated to 120° C. and, after dissolution, the temperature was raised to 160° C., with stirring. After being maintained at 160° C. for 1 hour the temperature was raised slowly to 230° C. over a period of 5 hours. Then the temperature was maintained at 230° C. and the reaction continued for 2 hours and then the temperature was dropped to 180° C. and 10 parts of trimellitic acid anhydride were added and the reaction was continued and then the reaction was stopped when the acid value reached 25 mgKOH/g and the mixture was cooled. After being cooled to below 80° C., parts of butyl cellosolve and then 3.2 parts of dimethylethanolamine were added and the resin was neutralized and then de-ionized water was added and the polyester resin solution E-2 of involatile fraction 30%, hydroxyl group value 90 mgKOH/g, acid value 25 mgKOH/g and number average molecular weight 2,000 was obtained.

<Preparation of Hydroxyl Group-containing Acrylic Resin Solution R-1>

Xylene (66.7 parts) was introduced into a four-necked flask which had been furnished with a thermometer, a reflux condenser, a stirrer and a dropping funnel and heated while being stirred under a current of nitrogen and maintained at 140° C. Then a drip-feed component where ethylenic unsaturated monomer comprising 10 parts of n-butyl methacrylate, 10 parts of styrene, 18 parts of n-butyl acrylate, 19.3 parts of cyclohexyl methacrylate, 41.7 parts of 2-hydroxyethyl methacrylate and 1 part of acrylic acid had been mixed uniformly with 5 parts of t-butylperoxy-2-ethylhexanoate as polymerization initiator was added dropwise at a constant rate from the dropping funnel over a period of 2 hours at a temperature of 140° C. After the drip feed had been completed the temperature was maintained at 140° C. for 1 hour, after which the reaction temperature was dropped to 110° C. After this a polymerization initiator solution where 0.1 part of t-butylperoxy-2-ethylhexanoate as a polymerization initiator had been dissolved in 1 part of xylene was added as supplementary catalyst, and after being maintained at 110° C. for 2 hours the reaction was terminated and the hydroxyl group-containing acrylic resin solution R-1 was obtained. The resin hydroxyl group value of the hydroxyl group-containing resin in the resin solution R-1 obtained was 180 mgKOH/g, the resin acid value was 7.2 mgKOH/g, the involatile fraction was 64.3% and the weight average molecular weight measured using gel permeation chromatography (GPC) was 5,600. Furthermore, the glass transition point of this hydroxyl group-containing resin was 29° C. Furthermore, all of the hydroxyl groups of the hydroxyl group-containing resin in the resin solution R-1 were primary hydroxyl groups.

Here the glass transition point is the numerical value calculated using the equation shown below.

$$1/Tg=\Sigma(mi/Tgi)$$

Tg: Glass transition point of the copolymer
mi: Mol fraction of the monomer i component
Tgi: Glass point (° K) of a homopolymer of the monomer i component

Examples of Production 1 to 10

Examples of the Aqueous First Colored Base Paints A-1 to A-5 and the Aqueous Second Colored Base Paints B-1 to B-5

The aqueous first colored base paints A-1 to A-5 and the aqueous second colored base paints B-1 to B-5 were made with the compounding proportions shown in Table 1. In Table 1 the units of the amounts of each component are parts by mass.

The aqueous first colored base paints and aqueous second colored base paints were prepared with the compounding proportions shown in Table 1 by adding carbon black (trade name MA-100, produced by Mitsubishi Kagaku), talc pigment (trade name Talc LMS-200, produced by Fuji Talc Kogyo) and true pigment (trade name Barium Sulfate B34, produced by Sakai. Kagaku) to the polyester resin emulsion E-2 and dispersing in a dispersing machine and then adding the polyurethane resin solution U-1, melamine resin (trade name Cymel 327, a methylated melamine resin produced by the Cytec Co., involatile fraction 90%), the polypropylene glycol (trade name Yuniol D1000, produced by the Nichiyu Co., number average molecular weight 1000), the surface controlling agent (trade name Beketol WS produced by the BYK Chemie Co.), and the rheology controlling agent (trade name Primal ASE-60, produced by the Rohm and Haas Co.), stirring in a dissolver and adjusting to a viscosity of 40 seconds/Ford cup 4# (20° C.) with de-ionized water.

TABLE 1

| Example of Production No. | 1 | 2 | 3 | 4 | 5 | 6 | 7 | 8 | 9 | 10 |
|---|---|---|---|---|---|---|---|---|---|---|
| Aqueous First Colored Base Coat No. | A-1 | A-2 | A-3 | A-4 | A-5 | | | | | |
| Aqueous Second Colored Base Coat No. | | | | | | B-1 | B-2 | B-3 | B-4 | B-5 |
| Polyester Resin Solution E-2 | 50 | 50 | 50 | 50 | 50 | 50 | 50 | 50 | 50 | 50 |
| Carbon Black | 8 | 8 | 8 | 8 | 8 | 8 | 8 | 8 | 8 | 8 |
| Talc Pigment | 0.5 | 1.5 | 3 | 4.7 | 7 | 0.5 | 1.5 | 3 | 4.7 | 7 |
| True Pigment | 15 | 15 | 15 | 15 | 15 | 15 | 15 | 15 | 15 | 15 |
| Polyurethane Resin Solution U-1 | 160 | 160 | 160 | 160 | 160 | 160 | 160 | 160 | 160 | 160 |
| Cymel 327 | 33.3 | 33.3 | 33.3 | 33.3 | 33.3 | 33.3 | 33.3 | 33.3 | 33.3 | 33.3 |
| Yuniol D1000 * | 15 | 15 | 15 | 15 | 15 | 15 | 15 | 15 | 15 | 15 |
| Surfactant | 2 | 2 | 2 | 2 | 2 | 2 | 2 | 2 | 2 | 2 |
| Rheology Controlling Agent | 0.5 | 0.5 | 0.5 | 0.5 | 0.5 | 0.5 | 0.5 | 0.5 | 0.5 | 0.5 |
| TOTAL | 284 | 285 | 287 | 288 | 291 | 269 | 270 | 272 | 273 | 276 |
| Total Resin Solid Fraction | 100 | 100 | 100 | 100 | 100 | 100 | 100 | 100 | 100 | 100 |
| Proportion of the Total Amount of Polyurethane Resin (a), Polyester Resin (b) and Melamine Resin (c) included (mass %, against total resin solid fraction) | 85 | 85 | 85 | 85 | 85 | 85 | 85 | 85 | 85 | 85 |

Note for Table 1

* Yuniol D1000 is an involatile material and has crosslinkable functional groups and so it is included in the resin solid fraction.

Production Example 11

Example of the Production of the Two-liquid Urethane Type Paint C-1

The hydroxyl group-containing acrylic resin solution R-1 (70 parts), 1.3 parts of ultraviolet absorber, Tinuvin 400 (trade name, produced by the Ciba Specialty Chemicals Co.), 0.7 part of photo-stabilizer, Tinuvin 292 (trade name, produced by the Ciba Specialty Chemical Co.), 0.2 part of surface controlling agent, BYK-300 (trade name, produced by the BYK Chemie Co.), 5 parts of diethylene glycol mono-butyl ether, 12.8 parts of n-butyl acetate and 10 parts of aromatic petroleum naphtha, Solvesso 100 (trade name, produced by the Esso Co.), were introduced sequentially and mixed in a dissolver until the system become uniform. Then 33.3 parts of aliphatic polyisocyanate solution, Basonat HI-172S (trade name, produced by the BASF Co., a 72% solution of HDI based isocyanate type trimer), were added and the two-liquid urethane type paint C-1 was obtained.

Examples 1 to 5

The cationic electro-deposition paint V-50 (trade name, produced by the Nippon Paint Co.) was electro-deposition painted in such a way as to provide a cured film thickness of about 20 μm on an alloyed molten zinc-plated steel sheet, which had been subjected to a zinc phosphate chemical-forming treatment, and then heated to 160° C. for 30 minutes and cured.

The aqueous first colored base paint shown in Table 2 was coated over the cured paint film of the electro-deposition paint with a bell rotating type electrostatic painting machine in such a way that the cured film thickness was from 7 to 12 μm and a first colored base paint film was formed and, after being left to stand for 5 minutes in the painting booth, the aqueous second colored base paint shown in Table 2 was coated with a bell rotating type electrostatic painting machine over the first colored base paint film in such a way that the cured film thickness was from 5 to 10 μm and a second colored base paint film was formed. This was left to stand for 5 minutes in the painting booth and then heated to 80° C. for 3 minutes and, after this preliminary heating, the clear paint C-1 was applied with a bell rotary type electrostatic painting machine over the second colored base paint film in such a way that the cured film thickness was from 30 to 35 μm and a clear paint film was formed and, after being left to stand for 10 minutes, this was heated and cured at 140° C. for 25 minutes to prepare a sample for paint film evaluation purposes on which a multi-layer paint film of three layers had been formed. Moreover, the painting was carried out under conditions of booth temperature 25° C. and relative humidity 75%.

Comparative Examples 1 to 4

Test samples for paint film evaluation purposes were prepared in the same way as in Examples 1 to 5 except that the aqueous first colored base paint and aqueous second colored base paint shown in Table 2 were used, and the results of the evaluations are shown in Table 2.

The multi-layer paint films obtained in the abovementioned examples and comparative examples were evaluated using the methods indicated below. These results are also shown in Table 2.

Moreover, Example 4 is a case where the first colored base paint and the second colored base paint are the same paint which contained the same resin constituting components and the same pigments.

<Evaluation Methods>

The paint film appearance and chipping resistance were evaluated using the methods outlined below.

Paint Film Appearance

The painted test sheet was observed visually and evaluated on the basis of the following criteria:

○: When a fluorescent lamp is reflected in the paint film the fluorescent lamp is reflected clearly.

Δ: When a fluorescent lamp is reflected in the paint film there is slight blurring around the fluorescent lamp (the profile of the lamp)

X: When a fluorescent lamp is reflected in the paint film there is pronounced blurring around the fluorescent lamp (the profile of the lamp)

Chipping Resistance

The painted test sheet was set at an angle of 45° in an environment at −20° C. in a flying-stone testing machine (trade name JA-400LA model, produced by Suga Jikenki) and twenty No. 7 stones selected between 0.9 and 1.1 g were propelled at 6.5 kg/cm$^2$ and made to collide with the paint film surface and, after stripping with cellophane tape, the area and state of the paint film which peeled away was assessed on the basis of the following criteria.

◎: No chips reaching the base and the average peeled away area per pebble was less than 2 mm$^2$ ○: No chips reaching the base and the average peeled away area per pebble was above 2 mm$^2$ but less than 4 mm$^2$ Δ: The average peeled away area was less than 4 mm$^2$ but the chips reached the base material.

X: The average peeled away area was less at least 4 mm$^2$ and the chips reached the base material.

TABLE 2

| | Example | | | | | Comparative Example | | | |
|---|---|---|---|---|---|---|---|---|---|
| | 1 | 2 | 3 | 4 | 5 | 1 | 2 | 3 | 4 |
| Aqueous First Colored Base Paint No. | A-2 | A-3 | A-3 | B-3 | A-4 | A-1 | A-1 | A-4 | A-5 |
| Aqueous Second Colored Base Paint No. | B-2 | B-2 | B-3 | B-3 | B-2 | B-1 | B-2 | B-5 | B-5 |
| Amount of Talc Pigment Included in the First Colored Base Paint (mass %, with respect to the total resin solid fraction) | 1.5 | 3 | 3 | 3 | 4.5 | 0.5 | 0.5 | 4.5 | 7 |
| Amount of Talc Pigment Included in the Second Colored Base Paint (mass %, with respect to the total resin solid fraction) | 1.5 | 1.5 | 3 | 3 | 1.5 | 0.5 | 1.5 | 7 | 7 |
| Paint Film Appearance | ○ | ○ | ○ | ○ | ○ | ○ | ○ | Δ | Δ |
| Chipping Resistance | ○ | ○ | ◎ | ◎ | ○ | Δ | Δ | X | X |

As is clear from Table 2, the Examples 1 to 5 of the method for the formation of a multi-layer paint film of the present invention had superior paint film appearance and chipping resistance when compared with Comparative Examples 1 to 4.

The invention claimed is:

1. A method for the formation of multi-layer paint films, comprising:

coating an aqueous first colored base paint (A) over an electro-deposition paint cured paint film to form a first colored base paint film, coating an aqueous second colored base paint (B) over the first colored base paint film without preliminary heating of the first colored base paint film to form a second colored base paint film, coating a clear paint (C) over the second colored base paint film after preliminary heating of the first colored base paint film and second colored base paint film to form a clear paint film, wherein the coating steps occur in succession and the second colored base paint film (B) is directly applied to the first colored base paint film (A), and the clear paint film (C) is directly applied to the second colored base paint film (B); and heating and curing the three paint films which have been formed at the same time, wherein a talc pigment is included in each of the aqueous colored first base paint (A) and aqueous colored second base paint (B) in an amount of from 1 to 5 mass % with respect to a total resin solid fraction of each of said aqueous colored first base paint (A) and aqueous colored second base paint (B); and wherein the first colored base paint film has a cured film thickness in the range of 5 to 30 μm, the second colored base paint film has a cured film thickness in the range of 5 to 30 μm, and the clear paint film has a cured film thickness in the range of 20 to 50 μm.

2. The method of claim 1 wherein the aqueous first colored paint (A) and the aqueous second colored paint (B) each comprise a polyurethane resin (a), a polyester resin (b) and a melamine resin (c) such that the proportion of the total amount of (a), (b) and (c) included in each of paint (A) and paint (B) is at least 70 mass % with respect to the total resin solid fraction of each of said paints.

3. The method of claim 1, wherein the aqueous first colored base paint (A) and the aqueous second colored base paint (B) are paints which contain the same resin constituting components and pigments.

4. The method of claim 1 wherein the clear paint (C) is a two-liquid urethane paint comprising a main agent which comprises a hydroxyl group-containing acrylic resin and a curing agent which contains a polyisocyanate compound.

5. The method of claim 4 wherein clear paint (C) comprises a hydroxyl group-containing acrylic resin having a hydroxyl group value of from 150 to 200 mgKOH/g, an acid value of from 4 to 15 mgKOH/g, a glass transition point of from 20 to 35° C. and a weight average molecular weight of from 4,000 to 7,000, and all of the hydroxyl groups in the resin are primary hydroxyl groups.

6. The method of claim 5 wherein the curing agent of the clear paint (C) comprises an aliphatic polyisocyanate compound.

7. The method of claim 1 wherein the electro-deposition paint cured paint film has been formed on a base material selected from the group consisting of alloyed molten zinc-plated steel sheet, molten zinc-plated steel sheet, electrically zinc-plated steel sheet and cold rolled steel sheet.

* * * * *